US007381456B2

(12) United States Patent
Fay et al.

(10) Patent No.: US 7,381,456 B2
(45) Date of Patent: Jun. 3, 2008

(54) FUNGI RESISTANT FACED INSULATION ASSEMBLY AND METHOD

(75) Inventors: Ralph Michael Fay, Lakewood, CO (US); Anthony E. Moore, Glen Allen, VA (US); Timothy D. Logsdon, Mechanicsville, VA (US); Blake Boyd Bogrett, Littleton, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 11/528,827

(22) Filed: Sep. 28, 2006

(65) Prior Publication Data

US 2007/0110939 A1 May 17, 2007

Related U.S. Application Data

(63) Continuation of application No. 10/703,130, filed on Nov. 6, 2003, now abandoned, which is a continuation-in-part of application No. 10/465,311, filed on Jun. 19, 2003, now abandoned, which is a continuation of application No. 10/394,134, filed on Mar. 20, 2003, now abandoned.

(51) Int. Cl.

| | |
|---|---|
| ***B32B 1/04*** | (2006.01) |
| ***A01N 25/34*** | (2006.01) |
| ***A01N 59/02*** | (2006.01) |
| ***D21H 11/00*** | (2006.01) |
| ***D21H 17/00*** | (2006.01) |
| ***D21H 19/00*** | (2006.01) |
| ***D21H 21/36*** | (2006.01) |
| ***E04B 1/74*** | (2006.01) |
| *B32B 3/02* | (2006.01) |
| *B65D 65/28* | (2006.01) |

(52) U.S. Cl. ..... 428/36.9; 428/68; 428/71; 428/74; 428/43; 428/126; 428/167; 428/907; 424/412; 424/413; 424/414; 424/415; 424/611; 424/703; 162/161; 52/98; 52/406.2; 52/407.3; 52/404.1; 52/408

(58) Field of Classification Search ..... 428/36.9, 428/68, 71, 74, 43, 126, 167, 907; 424/412–415, 424/611, 703; 162/161; 52/98, 406.2, 407.3, 52/407.4, 404.1, 408

See application file for complete search history.

(56) References Cited

U.S. PATENT DOCUMENTS

| | | | | |
|---|---|---|---|---|
| 2,280,460 | A * | 4/1942 | Voigt et al. | 156/391 |
| 2,496,566 | A * | 2/1950 | Szwarc | 428/491 |
| 4,629,645 | A * | 12/1986 | Inoue | 428/141 |
| 2001/0021711 | A1* | 9/2001 | Beilfuss et al. | 514/245 |
| 2001/0030018 | A1* | 10/2001 | Weinstein et al. | 156/257 |

* cited by examiner

*Primary Examiner*—Alicia Chevalier
*Assistant Examiner*—Christopher P Bruenjes
(74) *Attorney, Agent, or Firm*—Robert D. Touslee

(57) ABSTRACT

A kraft paper sheet contains and/or is coated with a fungi growth-inhibiting agent that causes the kraft paper sheet to be fungi growth resistant. The kraft paper sheet alone or as part of a layered sheet material is used as a central field portion of facings for various faced building insulation assemblies. The facings, as part of an insulation assembly, are fungi growth resistant; may be perforated to provide the facing with a selected water vapor permeance; and/or may include a bonding layer, such as a heat activated bonding layer, that bonds the facing to an insulation layer of the assembly.

2 Claims, 4 Drawing Sheets

FIG. 6
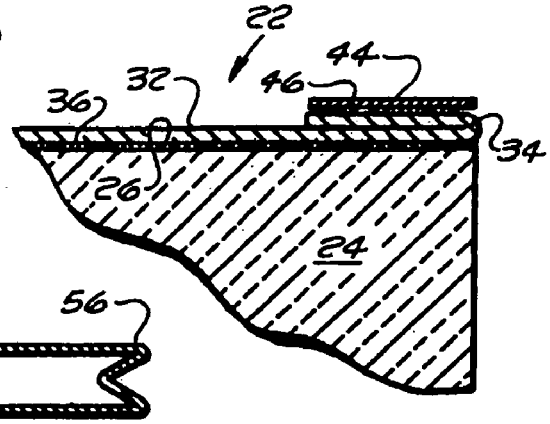
FIG. 7
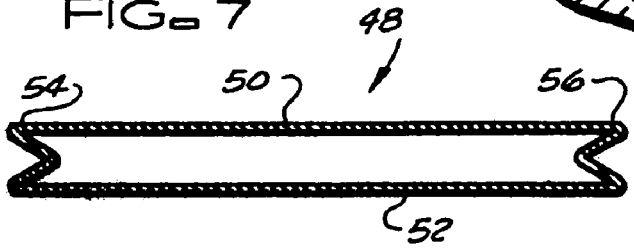
FIG. 8
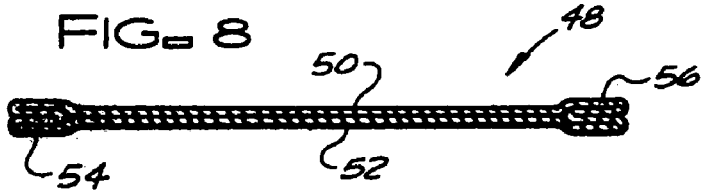
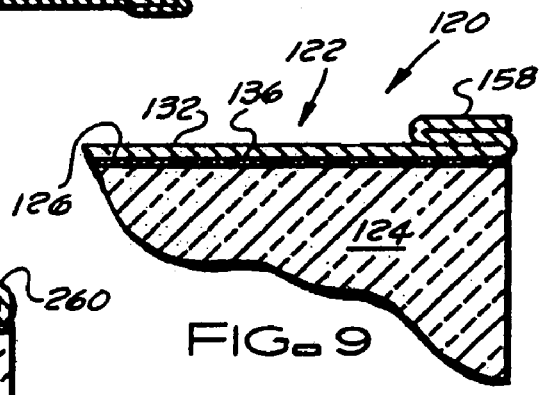
FIG. 9
FIG. 10
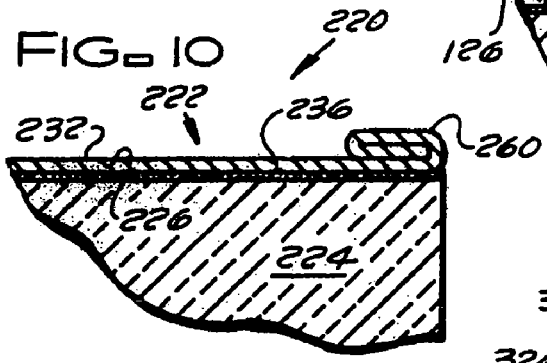
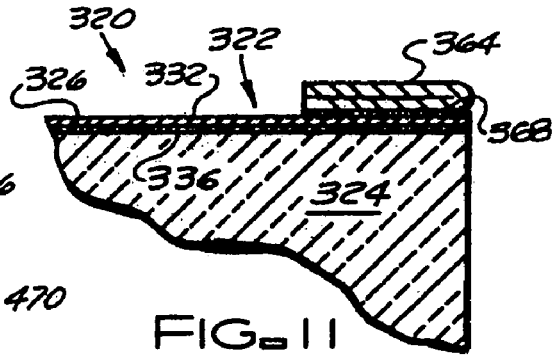
FIG. 11
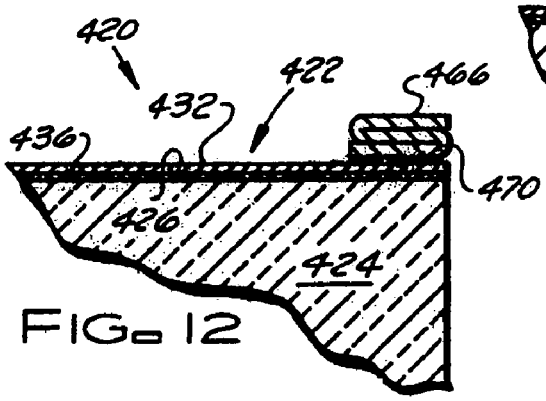
FIG. 12

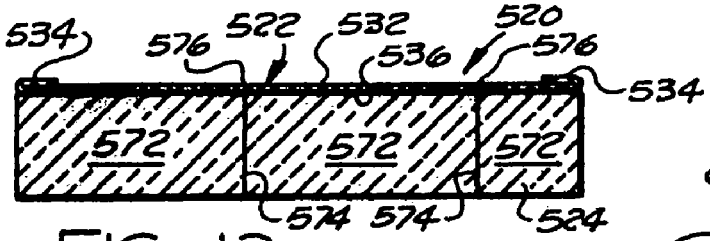
FIG. 13
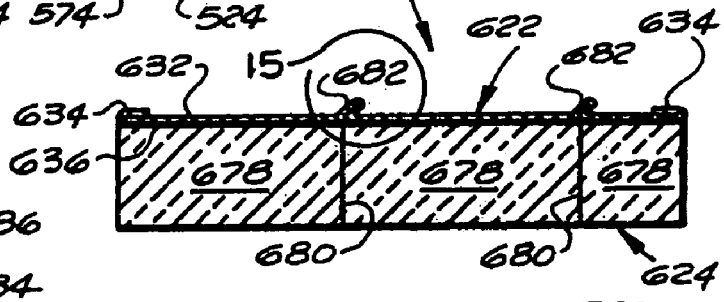
FIG. 14
FIG. 15
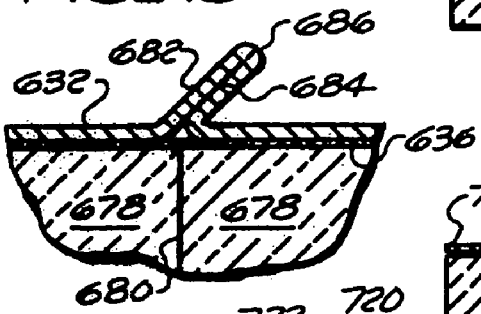
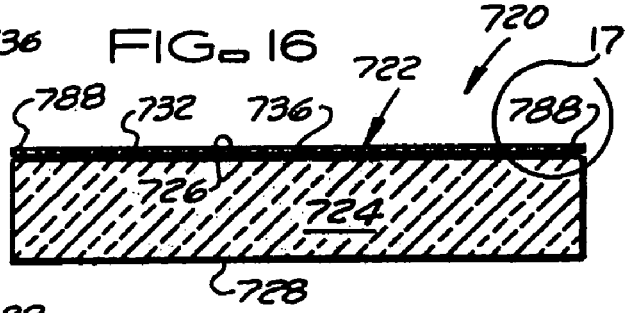
FIG. 16
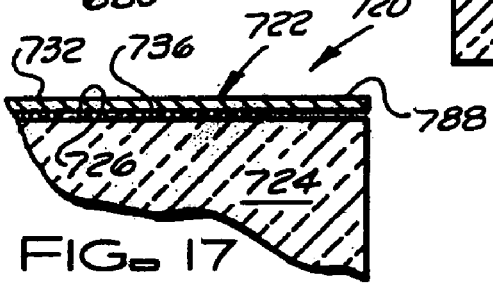
FIG. 17
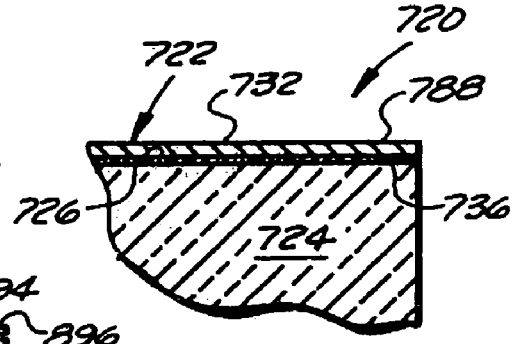
FIG. 18
FIG. 19
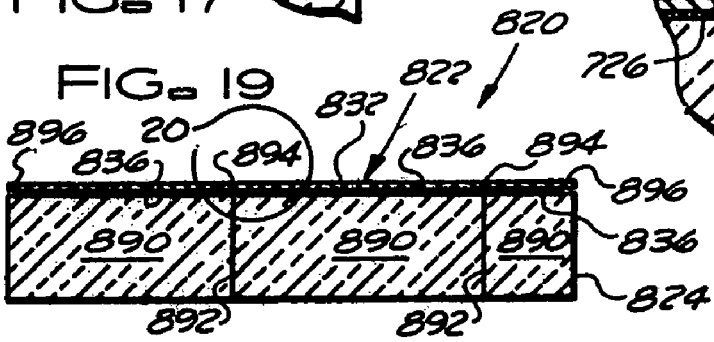
FIG. 20
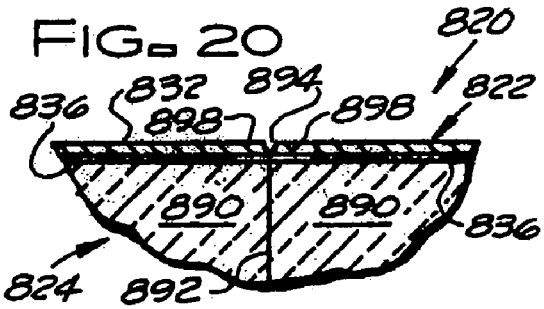
FIG. 21
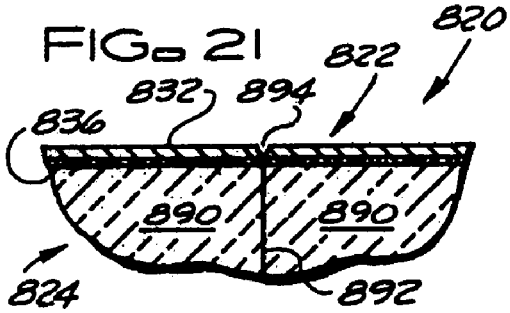

FUNGI RESISTANT FACED INSULATION ASSEMBLY AND METHOD

This patent application is a continuation of patent application Ser. No. 10/703,130, filed Nov. 6, 2003 now abandoned, which is a continuation-in-part of patent application Ser. No. 10/465,311 filed Jun. 19, 2003 now abandoned, which is a continuation of patent application Ser. No. 10/394,134 filed Mar. 20, 2003.

BACKGROUND OF THE INVENTION

The subject invention relates to a fungi growth resistant kraft paper, facings made with the fungi resistant kraft paper for faced building insulation assemblies, such as but not limited to faced building insulation assemblies commonly used to insulate homes and other residential building structures; offices, stores and other commercial building structures; and industrial building structures, and to the faced building insulation assemblies faced with such facings. The kraft paper facings of the subject invention are designed to exhibit improved fungi growth-inhibiting characteristics and may also exhibit other improved performance characteristics, such as but not limited to water vapor permeance ratings designed for particular applications, and improved functionality to improve installer productivity.

Building insulation assemblies currently used to insulate buildings, especially fiberglass building insulations, are commonly faced with kraft paper facings, such as 30-40 lbs/3MSF (30 to 40 pounds/3000 square feet) natural kraft paper. In addition, U.S. Pat. Nos. 5,733,624; 5,746,854; 6,191,057; and 6,357,504 disclose examples of polymeric facings for use in faced building insulation assemblies and U.S. patent application Nos. US 2002/0179265 A1; US 2002/0182964 A1; and US 2002/0182965 A1 disclose examples of polymeric-kraft laminates for use in faced building insulation assemblies.

While building insulation assemblies faced with such kraft paper facings function quite well, have been used for decades, and the patents listed above disclose kraft paper facing materials as well as alternative facing materials, there has remained a need for facings with improved performance characteristics. The improved kraft paper of the subject invention, the improved kraft paper facings of the subject invention, and the building insulation assemblies faced with the improved kraft paper facings of the subject invention provide faced insulation assemblies designed to exhibit improved fungi growth-inhibiting characteristics over current kraft paper facings commonly used to face insulation assemblies. The facings of the subject invention may also exhibit improved pest control characteristics, exhibit other improved performance characteristics (e.g. reduced flame spread, reduced smoke development and/or improved water vapor permeance ratings), and/or enable improved installer productivity or other cost savings.

SUMMARY OF THE INVENTION

The fungi growth resistant kraft paper of the subject invention can be used for many applications where unwanted fungi growth is typically encountered. However, the fungi growth resistant kraft paper of the subject invention is particularly useful as a sheet material for the facings of the faced building insulation assemblies of the subject invention. The fungi growth resistant kraft paper of the subject invention and the facings of the subject invention, made with the fungi growth resistant kraft paper of the subject invention, contain or are coated with one or more fungi growth-inhibiting agents. The fungi growth resistant kraft paper and facing are fungi growth resistant as defined herein and, preferably exhibit no more than traces of sporulating growth, non-sporulating growth, or both sporulating and non-sporulating growth as defined herein and more preferably, exhibit no sporulating growth or non-sporulating growth as defined herein.

When a surface of a specimen of a kraft paper sheet material of the subject invention or a facing of the subject invention, as bonded to an insulation layer of a faced insulation assembly of the subject invention, and a surface of a comparative specimen of a white birch or southern yellow pine wood, which are each approximately 0.75 by 6 inches (20 by 150 mm), are tested as follows, the specimen of kraft paper sheet material or facing of the subject invention will have less spore growth than the comparative specimen of white birch or southern yellow pine. Spore suspensions of *aspergillus niger, aspergillus versicolor, penicillium funiculosum, chaetomium globosum*, and *asperguillus flavus* are prepared that each contain 1,000,000±200,000 spores per mL as determined with a counting chamber. Equal volumes of each of the spore suspensions are blended together to produce a mixed spore suspension. The 0.75 by 6 inch surface of the specimen of the kraft paper sheet material or facing of the subject invention and the 0.75 by 6 inch surface of the comparative specimen of white birch or southern yellow pine wood are each inoculated with approximately 0.50 mL of the mixed spore suspension by spaying the surfaces with a fine mist from a chromatography atomizer capable of providing 100,000±20,000 spores/inch$^2$. The specimens are immediately placed in an environmental chamber and maintained at a temperature of 86±4° F. (30±2° C.) and 95±4% relative humidity for a minimum period of 28 days±8 hours from the time incubation commenced (the incubation period). At the end of the incubation period, the specimens are examined at 40× magnification. The specimen of the kraft paper sheet material or facing of the subject invention passes the test provided the specimen of the kraft paper sheet material or facing has less spore growth than the comparative specimen of white birch or southern yellow pine wood. As used in this specification and claims the term "fungi growth resistant" means the observable spore growth at a 40× magnification on the surface of a kraft paper sheet material or facing specimen being tested is less than the observable spore growth at a 40× magnification on either a white birch or southern yellow pine comparative specimen when the specimens are tested as set forth in this paragraph.

When a surface of a 50-mm by 50-mm specimen or 50-mm diameter specimen of a kraft paper sheet material of the subject invention or a facing of the subject invention, as bonded to an insulation layer of a faced insulation assembly of the subject invention, has been tested as follows, the specimen will preferably, exhibit only microscopically observable traces of sporulating growth, non-sporulating growth, or both sporulating and non-sporulating growth and, more preferably, exhibit no microscopically observable sporulating growth or non-sporulating growth. Separate spore suspensions of *aspergillus niger, penicillium pinophilum, chaetomium globosum, gliocladium virens*, and *aureobasidium pullulans* are prepared with a sterile nutrient-salts solution. The spore suspensions each contain 1,000,000±200,000 spores per mL as determined with a counting chamber. Equal volumes of each of the spore suspensions are blended together to produce a mixed spore suspension. A solidified nutrient-salts agar layer from 3 to 6 mm (⅛ to ¼ inch) is provided in a sterile dish and the specimen is placed on the surface of the agar. The entire exposed surface of the specimen is inoculated and moistened with the mixed spore suspension by spraying the suspension from a sterilized atomizer with 110 kPa (16 psi) of air pressure. The specimen is covered and incubated at 28 to 30° C. (82 to 86° F.) in an atmosphere of not less than 85% relative humidity for 28 days. The surface of the specimen is then microscopically observed to visually examine for sporulating and/or non-sporulating growth. The magnification used for making the microscopic observations to determine both sporulating growth and non-sporulating growth is selected to enable non-sporulating growth to be observed. As used in this specification and claims the term "traces of sporulating growth, non-sporulating growth, or both sporulating and non-sporulating growth" means a microscopically observable sporulating growth, non-sporulating growth, or both sporulating and non-sporulating growth of the mixed spore suspension on the surface of a specimen being tested when the specimen is tested under the conditions set forth in this paragraph that, at the conclusion of 28 days, cover(s) less than 10% of the surface area of the surface of the specimen being tested. As used in this specification and claims the term "no sporulating growth or non-sporulating growth" means no observable sporulating growth or non-sporulating growth of the mixed spore suspension on the surface of the specimen being tested at the conclusion of 28 days when the specimen is tested under the conditions set forth in this paragraph.

The facing of the subject invention also: may include a pesticide; may be modified to provide the facing with a selected water vapor permeance, e.g. may be perforated or otherwise modified to provide the facing with a selected water vapor permeance, and/or may include a heat activated bonding layer that bonds the facing to the insulation layer of the assembly. As used herein the term "bonding layer" includes both a bonding layer that does not require heat activation, such as but not limited to a conventional pressure sensitive adhesive in the form of a coating layer, a spray on particulate layer, a spray on fiberized adhesive layer, or other continuous or discontinuous adhesive layers, and a heat activated bonding layer, such as but not limited to an asphalt or modified-asphalt coating layer (hereinafter "asphalt coating layer"), a wax coating layer, a polymeric film, a polymeric coating, a polymeric fiber mat, a polymeric fiber mesh, a spray on particulate or fiberized polymer, or other continuous or discontinuous heat activated bonding layers having a softening point temperature sufficiently low to enable the heat activated bonding layer to be heated to a temperature to effect a bond between the facing and a major surface of the insulation layer without degrading the facing. The bonding layer may be pre-applied to the facing or applied to the facing and/or major surface of the insulation layer at the point where the facing and the insulation layer are being combined. With respect to the polymeric heat activated bonding layers used to bond the facing of the subject invention to an insulation layer, polypropylene and polyethylene are preferred polymers for use as the heat activated bonding layer. The bonding layer used to bond a facing of the subject invention to an insulation layer may be used to increase the water repellency of the facing and make the facing less susceptible to fungi growth by reducing the presence of moisture in the insulation assembly. In addition, the bonding layer may be used to reduce the water vapor permeance rating of selected facings of the subject invention. The bonding layer used to bond the facing of the subject invention to an insulation layer may also include one or more fungi-growth inhibiting agents.

As used herein, the term "laminate" means two or more layers of one or more materials that are superposed and united.

The facing of the subject invention may have lateral tabs, may be tabless, or may have lateral tabs made from a sheet material that differs from the sheet material of the field portion of the facing and that are sufficiently transparent to enable framing members to be seen through the tabs, sufficiently open to enable wallboard to be directly bonded to framing members overlaid by the tabs, and/or sufficiently greater in integrity than the field portion of the facing to permit a less expensive material to be used for the field portion of the facing. The field portion of the facing of the subject invention may include a mineral coating (e.g. clay coating) layer or layers with modifiers or a polymeric coating or film layer or layers with modifiers to stiffen the facing, inhibit fungi growth, treat or control pests, and/or decrease the flame spread and smoke formation characteristics of the facing. The field portion of the facing of the subject invention may include a polymeric filament or fiber mat layer or layers or a glass fiber mat layer or layers.

The facing of the subject invention may be formed from gusseted tubular sheet materials. The facing of the subject invention may be separable longitudinally at spaced apart locations in the central field portions of the facings so that the facings can be applied to pre-cut longitudinally separable insulation layers and separated where the pre-cut longitudinally separable insulation layers are separable. The building insulation assemblies of the subject invention may have laterally compressible resilient insulation layers faced with facings having portions, e.g. lateral edge portions, which are or which may be separated from the insulation layers when the insulation layers are laterally compressed to form tabs. The building insulation assemblies of this paragraph may utilize any of the facing materials of the subject invention.

The fungi growth resistant sheet materials of the subject invention, typically in widths of about four feet or more, may be applied as vapor retarders directly to the framing members of a wall where unfaced insulation is used to insulate the wall cavities.

The faced insulation assembly of the subject invention may include an insulation assembly with a facing of the subject invention and at least one reflective sheet that radiates heat, such as but not limited to a foil sheet, a metallized film, or other metallized sheet material.

BRIEF DESCRIPTION OF THE DRAWINGS

FIG. 6 is partial schematic view of another embodiment of the faced insulation assembly of the subject invention showing a tab strip bonded to one of the tabs of the facing of FIGS. 1 to 3.

FIG. 7 is a schematic transverse cross section though a tubular sheet material with lateral gussets that can be made into a facing of the subject invention.

FIG. 8 is a schematic transverse cross section through the tubular sheet material of FIG. 7 after the tubular sheet material has been collapsed and bonded together.

FIGS. 9 to 12 are partial schematic views of embodiments of the faced insulation assembly of the subject invention showing other tabs that may be substituted for the tabs shown on the facing of FIGS. 1 to 3. The partial schematic views of FIGS. 9 to 12 correspond to the view of FIG. 3 for the embodiment of FIGS. 1 to 3.

FIG. 13 is a schematic end view of a faced pre-cut insulation assembly with a facing of the subject invention that is longitudinally separable at each location where the insulation layer is longitudinally separable.

FIG. 14 is a schematic end view of a faced pre-cut insulation assembly with a facing of the subject invention that is longitudinally separable at each location where the insulation layer is longitudinally separable and provided with tabs at each location where the insulation layer is separable.

FIG. 15 is schematic view of the circled portion of FIG. 14 on a larger scale than FIG. 14.

FIG. 16 is a schematic end view of a faced insulation assembly of the subject invention where the facing is without preformed tabs.

FIG. 17 is a schematic view of the circled portion of FIG. 16 on a larger scale than FIG. 16.

FIG. 18 is a schematic view of a modified version of the circled portion of FIG. 16 on a larger scale than FIG. 16.

FIG. 19 is a schematic end view of a faced pre-cut insulation assembly with a facing of the subject invention that has no preformed tabs and is longitudinally separable at each location where the insulation layer is longitudinally separable.

FIG. 20 is a schematic view of the circled portion of FIG. 19 on a larger scale than FIG. 19.

FIG. 21 is a schematic view of a modified version of the circled portion of FIG. 19 on a larger scale than FIG. 19.

DESCRIPTION OF THE PREFERRED EMBODIMENTS

Figure 1:
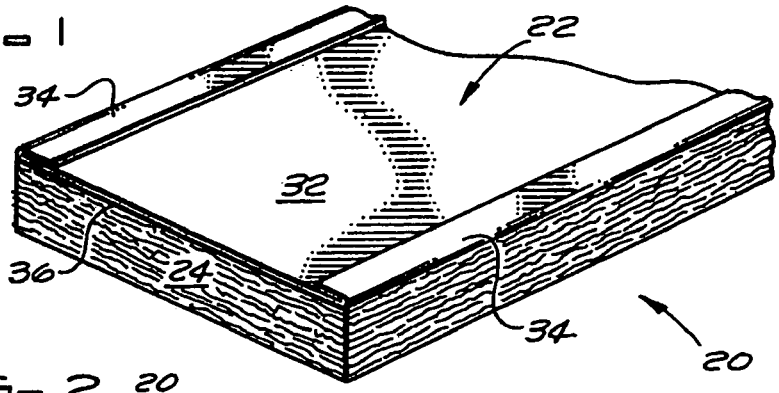
FIG. 1 is a schematic perspective view of a first embodiment of the faced insulation assembly of the subject invention.
Figure 2:
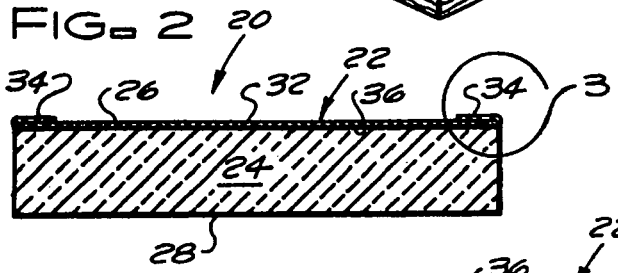
FIG. 2 is a schematic end view of the faced insulation assembly of FIG. 1.

FIGS. 1 and 2 show a typical faced insulation assembly 20 of the subject invention. The faced insulation assembly 20 includes a facing 22 of the subject invention and an insulation layer 24. The insulation layer 24 has first and second major surfaces 26 and 28, which are defined by the length and width of the insulation layer, and a thickness. The facing 22 of the faced insulation assembly 20 is formed of a sheet material that has a central field portion 32 and a pair of lateral tabs 34 that are typically between 0.25 and 1.5 inches in width. The lateral tabs 34 can be unfolded and extended beyond the lateral surfaces of the insulation layer 24 of the faced insulation assembly 20 (typically extended between 0.25 and 1.5 inches beyond the lateral surfaces of the insulation layer) for attachment to framing members forming a cavity being insulated by the faced insulation assembly and/or unfolded and extended beyond the lateral surfaces of the insulation layer 24 of the faced insulation assembly 20, e.g. to overlap the framing members forming a cavity being insulated by the faced insulation assembly. The central field portion 32 of the sheet has a first outer major surface and a second inner major surface. The central field portion 32 of the sheet overlays and is bonded, typically by a bonding layer 36 on the inner major surface of central field portion 32 of the sheet, to the major surface 26 of the insulation layer 24.

Figure 4:
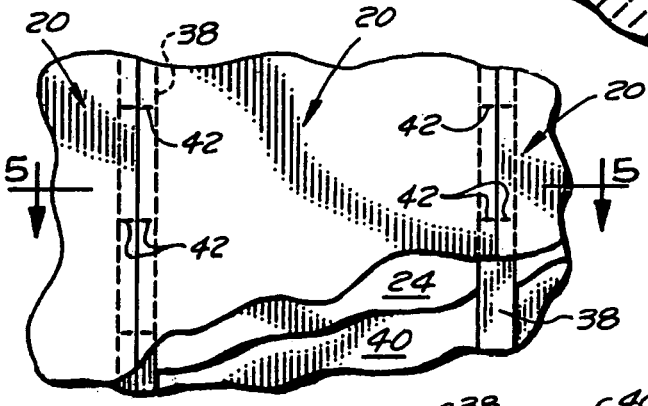
FIGS. 4 and 5 are schematic views of faced insulation assemblies of FIGS. 1 to 3 installed in a wall cavity.
Figure 5:
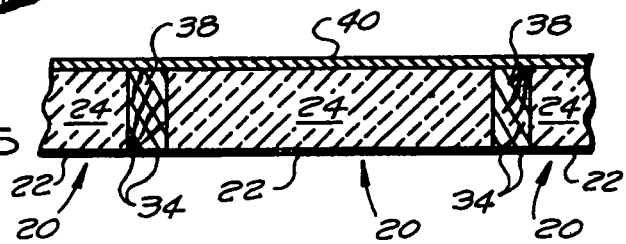

FIGS. 4 and 5 show faced insulation assemblies 20 installed in a wall cavity defined on three sides by two spaced apart framing members 38 (e.g. wooden 2×4 or 2×6 studs) and a sheet of sheathing 40. As shown in FIG. 4, the tabs 34 of the faced insulation assemblies 20 are secured to the end surfaces of the framing members 38 by staples 42. While the insulation assemblies 20 are shown installed in wall cavities, the insulation assemblies 20 may also be installed between framing members in other building cavities such as but not limited to ceiling, floor, and roof cavities. While, as shown, the tabs 34 are stapled to the end surfaces of the faming members 38, the tabs may be stapled to the side surfaces of the framing members 38, may be bonded to the end surfaces of the framing members 38 or the side surfaces of the framing members 38, may overlap end surfaces of the framing members 38 without being secured to the framing members, or, if desired, may be left in their initial folded configuration.

Figure 3:
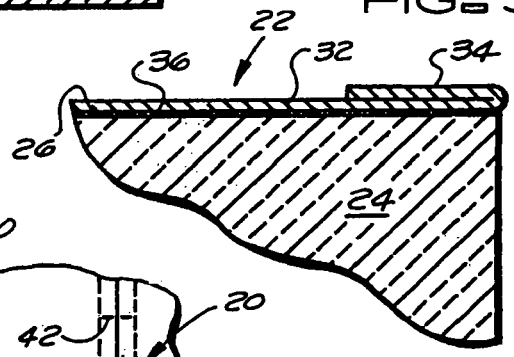
FIG. 3 is a schematic view of the circled portion of FIG. 2 on a larger scale than FIG. 2.

FIG. 6 shows a partial cross section of the facing 22 of FIGS. 1 to 3 that corresponds to FIG. 3 wherein the lateral tabs 34 include tab strips 44. The lateral tabs 34 each have a tab strip 44 that overlays, is coextensive or essentially coextensive with, and is bonded to one surface of the lateral tab 34. The tab strips 44 provide the lateral tabs 34 with increased integrity relative to central field portion 32 of the facing sheet 22 for handling and stapling and may be selected to have sufficient integrity to enable the use of thinner and/or less expensive sheet materials for the facing sheet 22. In addition, the tab strips 44 may also function as release liners overlaying layers or coatings 46 of pressure-sensitive adhesives on the lateral tabs 34 that may be used to secure the lateral tabs 34 to framing members 38.

While the insulation layers faced with the facings of the subject invention may be made of other materials, such as but not limited to foam insulation materials, preferably, the insulation layers of the insulation assemblies of the subject invention are resilient fibrous insulation blankets and, preferably, the faced conventional uncut resilient fibrous insulation blankets and the faced pre-cut resilient fibrous insulation blankets of the subject invention are made of randomly oriented, entangled, glass fibers and typically have a density between about 0.3 pounds/$ft^3$ and about 1.6 pounds/$ft^3$. Examples of fibers that may be used other than or in addition to glass fibers to form the faced resilient insulation blankets of the subject invention are mineral fibers, such as but not limited to, rock wool fibers, slag fibers, and basalt fibers; organic fibers such as but not limited to polypropylene, polyester and other polymeric fibers; natural fibers such as but not limited to cellulose, wood, flax and cotton fibers; and combinations of such fibers. The fibers in the faced resilient insulation blankets of the subject invention may be bonded together at their points of intersection for increased integrity, e.g. by a binder such as but not limited to a polycarboxy polymers, polyacrylic acid polymers, a urea phenol formaldehyde or other suitable bonding material, or the faced resilient fibrous insulation blankets of the subject invention may be binder-less provided the blankets possess the required integrity and resilience.

While the faced resilient fibrous insulation blankets of the subject invention may be in roll form (typically in excess of 117 inches in length), for most applications, such as the insulation of walls in homes and other residential structures, the faced resilient fibrous insulation blankets of the subject invention are in the form of batts about 46 to about 59 inches in length (typically about 48 inches in length) or 88 to about 117 inches in length (typically about 93 inches in length). Typically, the widths of the faced resilient fibrous insulation blankets are substantially equal to or somewhat greater than standard cavity width of the cavities to be insulated, for example: about 15 to about 15½ inches in width (a nominal width of 15 inches) for a cavity where the center to center spacing of the wall, floor, ceiling or roof framing members is about 16 inches (the cavity having a width of about 14½ inches); and about 23 to about 23½ inches in width (a nominal width of 23 inches) for a cavity where the center to center spacing of the wall, floor, ceiling or roof framing members is about 24 inches (the cavity having a width of about 22½ inches). However, for other applications, the faced resilient fibrous insulation blankets may have different initial widths determined by the standard widths of the cavities to be insulated by the insulation blankets.

The amount of thermal resistance or sound control desired and the depth of the cavities being insulated by the faced insulation assemblies determine the thicknesses of the faced insulation assemblies of the subject invention, e.g. faced resilient fibrous insulation blankets. Typically, the faced insulation assemblies are about three to about ten or more inches in thickness and approximate the depth of the cavities being insulated. For example, in a wall cavity defined in part by nominally 2×4 or 2×6 inch studs or framing members, a faced pre-cut resilient fibrous insulation blanket will have a thickness of about 3½ inches or about 5½ inches, respectively.

A first sheet material that may be used for the facing 22 of the faced insulation assembly 20 and for the other facings of the faced insulation assemblies of the subject invention is a bleached or unbleached natural kraft paper sheet (such as but not limited to a 35-38 lbs/3MSF natural kraft paper, a 30-40 lbs/3MSF lightweight kraft paper, or a 35-38 lbs/3MSF extensible natural kraft paper) that contains and/or is coated on one or both major surfaces with a fungi growth-inhibiting agent or a blend of fungi growth-inhibiting agents in amounts that result in the first sheet material being fungi growth resistant. Preferably the first sheet material exhibits no more than traces of sporulating growth, non-sporulating growth, or both sporulating growth and non-sporulating growth, and more preferably, no sporulating growth or non-sporulating growth. A preferred kraft paper sheet of the subject invention either contains between 200 and 2000 ppm (parts per million), more preferably between 300 and 700 ppm, and most preferably between 400 and 600 ppm of the fungi growth-inhibiting agent 2-(4Thiazolyl) Benzimidazole (a chemical also known as "TBZ") or is coated on one or both major surfaces with a suspension containing between 200 and 2000 ppm, more preferably between 300 and 700 ppm, and most preferably between 400 and 600 ppm of the fungi growth-inhibiting agent TBZ. The first sheet material that may be used for the facing 22 may also have an inner bonding layer that does not require heat activation to bond the facing to an insulation layer or a heat activated bonding layer (e.g. an asphalt coating layer, a wax coating layer, a polymeric film layer, or polymeric coating layer) on the inner major surface of the kraft paper with a low temperature softening point, which can be heated, softened, and used to bond the facing to the insulation layer (e.g. a fiberglass insulation layer) without negatively impacting the physical properties or the visual appearance of the facing or otherwise degrading the facing. This bonding layer may include a fungi growth-inhibiting agent such as TBZ and the fungi growth-inhibiting agent may be present in the bonding layer in amounts such as those set forth above for the first sheet material.

In tests conducted in accordance with ASTM tests C1338 and G21 either no sporulating growth or non-sporulating growth or no more than traces of sporulating growth, non-sporulating growth, or both sporulating growth and non-sporulating growth was observed in kraft paper including 650 ppm 2-(4-Thiazolyl) Benzimidazole, while untreated kraft paper exhibited growth as soon as the $7^{th}$ day observation. In a test performed to the ASTM-G21 standard over a 36 day period, of the twenty readings at the end of the 36 day period (10 samples one reading per side), 13 readings observed no sporulating or non-sporulating growth and 4 readings observed no more than traces of sporulating growth, non-sporulating growth, or both sporulating growth and non-sporulating growth. Readings of control samples of kraft paper currently used for facing fiberglass insulation products observed heavy sporulating growth, non-sporulating growth, or both sporulating growth and non-sporulating growth for all readings at the end of the 36-day period.

A second sheet material that may be used for the facing 22 of the faced insulation assembly 20 and for the other facings of the faced insulation assemblies of the subject invention is a mineral coated inexpensive thin lightweight kraft paper sheet laminate (e.g. a clay coated 30-40 lbs/3MSF kraft paper laminate or a clay coated 20-30 lbs/3MSF kraft paper laminate) that may be used rather than a 35-38 lbs/3MSF extensible natural kraft commonly used to face fiberglass insulation assemblies. The kraft paper sheet of the second sheet material contains and/or is coated on one or both major surfaces with a fungi growth-inhibiting agent or a blend of fungi growth-inhibiting agents in amounts that result in the second sheet material being fungi growth resistant. A preferred kraft paper sheet of the subject invention for use in the second sheet material either contains between 200 and 2000 ppm (parts per million), more preferably between 300 and 700 ppm, and most preferably between 400 and 600 ppm of the fungi growth-inhibiting agent 2-(4-Thiazolyl) Benzimidazole or is coated on one or both major surfaces with a suspension containing between 200 and 2000 ppm, more preferably between 300 and 700 ppm, and most preferably between 400 and 600 ppm of the fungi growth-inhibiting agent TBZ. The mineral coating layer forms the outer layer and the outer major surface of the second sheet material. At a relatively low cost, the mineral coating layer increases the stiffness and body of the second sheet material, the integrity of the second sheet material, the "cuttability" of the second sheet material, the "cuffability" (ability of the fourth sheet material to hold a fold when forming tabs), and the fire resistance of the second sheet material. The mineral coating can also provide the facing with other performance enhancing characteristics to improve the overall performance of the faced insulation assemblies of the subject invention. For example, the mineral coating can include a pesticide (e.g. an insecticide, a termiticide), a desired coloration, etc. The mineral coating may be paint. The second sheet material that may be used for the facing 22 may also have an inner bonding layer that does not require heat activation to bond the facing to an insulation layer or a heat activated bonding layer (e.g. an asphalt coating layer, a wax coating layer, a polymeric film layer, or polymeric coating layer) on the inner major surface of the kraft paper with a low temperature softening point, which can be heated, softened, and used to bond the facing to the insulation layer (e.g. a fiberglass insulation layer) without negatively impacting the physical properties or visual appearance of the facing or otherwise degrading the facing. This bonding layer may include a fungi growth-inhibiting agent such as TBZ and the fungi growth-inhibiting agent may be present in the bonding layer in amounts such as those set forth above for the second sheet material.

A third sheet material that may be used for the facing 22 of the faced insulation assembly 20 and for the other facings of the faced insulation assemblies of the subject invention is a laminate including a natural kraft paper or tissue paper sheet overlaid on both major surfaces with a polymeric coating or film layer. The kraft paper sheet of the third sheet material contains and/or is coated on one or both major surfaces with a fungi growth-inhibiting agent or a blend of fungi growth-inhibiting agents in amounts that result in the third sheet material being fungi growth resistant. A preferred kraft paper sheet of the subject invention for use in the third sheet material either contains between 200 and 2000 ppm (parts per million), more preferably between 300 and 700 ppm, and most preferably between 400 and 600 ppm of the fungi growth-inhibiting agent 2-(4-Thiazolyl) Benzimidazole or is coated on one or both major surfaces with a suspension containing between 200 and 2000 ppm, more preferably between 300 and 700 ppm, and most preferably between 400 and 600 ppm of the fungi growth-inhibiting agent TBZ. The polymeric coating or film layers encapsulate the natural kraft paper or tissue paper and thereby make the sheet material more moisture resistant than a typical uncoated kraft facing material. An example of a polymeric coating or film layer is a polyolefin coating or film layer, such as but not limited to a polyethylene or polypropylene coating or film layer with a fungi growth-inhibiting agent. An example of the third sheet material is a laminate that includes an unbleached natural kraft base layer, e.g. a 20-30 lb/3MSF natural kraft that is encapsulated between outer and inner white-pigmented HDPE film layers such as HDPE film layers applied at a weight of about 7-15 lbs/3MSF. This example of the third sheet material is a balanced sheet material that protects the encapsulated kraft layer, has excellent fold-ability (folds easily and holds the fold), is almost waterproof, and exhibits increased toughness. The polymeric coating or film layer forming the outer layer of the laminate and the outer major surface of the laminate may have a higher temperature softening point than the polymeric coating or film layer forming the inner layer of the laminate and the inner major surface of the laminate e.g. the outer polymeric layer may have a softening point of about 250° F. while the inner polymeric layer may have a softening point of less than 190° F. (a 60° F. temperature difference). The inner layer of the laminate can thus be used as a heat activated bonding layer for bonding the facing to the first major surface of the insulation layer (e.g. a fiberglass-insulation layer) without negatively impacting the physical properties or visual appearance of the facing or otherwise degrading the facing. This inner layer may include a fungi growth-inhibiting agent such as TBZ and the fungi growth-inhibiting agent may be present in the bonding layer in amounts such as those set forth above for the third sheet material. The outer polymeric layer can be made is various colors. A preferred color for a facing used in a faced insulation assembly with a white insulation layer, such as a white, formaldehyde free, fiberglass insulation layer, is white.

A fourth sheet material that may be used for the facing 22 of the faced insulation assembly 20 and for the other facings of the other faced insulation assemblies of the subject invention is a laminate including a natural kraft paper or tissue paper sheet overlaid on one major surface (the outer surface as applied to the insulation layer) with a polymeric coating or film layer. The kraft paper sheet of the fourth sheet material contains and/or is coated on one or both major surfaces with a fungi growth-inhibiting agent or a blend of fungi growth-inhibiting agents in amounts that result in the fourth sheet material being fungi growth resistant. A preferred kraft paper sheet of the subject invention for use in the third sheet material either contains between 200 and 2000 ppm (parts per million), more preferably between 300 and 700 ppm, and most preferably between 400 and 600 ppm of the fungi growth-inhibiting agent 2-(4-Thiazolyl) Benzimidazole or is coated on one or both major surfaces with a suspension containing between 200 and 2000 ppm, more preferably between 300 and 700 ppm, and most preferably between 400 and 600 ppm of the fungi growth-inhibiting agent TBZ. An example of a polymeric coating or film layer is a polyolefin coating or film layer, such as but not limited to a polyethylene or polypropylene coating or film layer with a fungi growth-inhibiting agent such as TBZ in amounts such as those set forth above for the fourth sheet material. An example of the fourth sheet material is a laminate that includes an unbleached natural kraft base layer, e.g. a 20-30 lb/3MSF natural kraft that is coated with an outer white-pigmented HDPE film layer such as an HDPE film layer applied at a weight of about 7-15 lbs/3MSF. The outer polymeric layer can be made in various colors. A preferred color for a facing used in a faced insulation assembly with a white insulation layer, such as a white, formaldehyde free, fiberglass insulation layer, is white. The fourth sheet material that may be used for the facing 22 may also have an inner bonding layer that does not require heat activation to bond the facing to an insulation layer or a heat activated bonding layer (e.g. an asphalt coating layer, a wax coating layer, a polymeric film layer, or polymeric coating layer) on the inner major surface of the kraft paper with a low temperature softening point, which can be heated, softened, and used to bond the facing to the insulation layer (e.g. a fiberglass insulation layer) without negatively impacting the physical properties or visual appearance of the facing or otherwise degrading the facing. This bonding layer may include a fungi growth-inhibiting agent such as TBZ and the fungi growth-inhibiting agent may be present in the bonding layer in amounts such as those set forth above for the second sheet material.

A fifth sheet material that may be used for the facing 22 of the faced insulation assembly 20 and for the other facings of the other faced insulation assemblies of the subject invention is a collapsed tubular kraft paper sheet material that includes first and second lateral gusset portions. Any of the first through the fourth sheet materials can be used to form the fifth sheet material. As shown in FIGS. 7 and 8, which show the tubular sheet material 48 prior to and after the sheet has been collapsed to form the facing, the tubular sheet material has first and second central portions 50 and 52 extending between and joining the two lateral gusset portions 54 and 56. The central portions 50 and 52 of the collapsed tubular sheet material are bonded together to form the central field portion of the facing sheet. As shown the lateral gusset portions 54 and 56 each include four layers while the central portion of the collapsed tubular sheet material includes two layers. By including an additional lateral gusset or gussets, the lateral gusset portions could each include six or more layers. The inclusion of additional layers in each of the lateral gusset portions 54 and 56 of the collapsed tubular sheet material relative to the central portion of the collapsed tubular sheet material enables the formation of lateral tabs on the facing of increased integrity and tear through resistance while using a thinner or less expensive sheet material to form collapsed tubular sheet material.

As previously indicated, the kraft paper sheet of each of the first through fifth sheet materials discussed above for the facings of the subject invention contains or is coated with a fungi growth-inhibiting agent ("a mildewcide") to inhibit the growth of fungi during storage, shipment and service and may also include a pesticide such as but not limited to an insecticide or termiticide e.g. fipronil. The facings are fungi growth resistant and preferably, each facing of the subject invention exhibits no more than traces of sporulating growth, non-sporulating growth, or both sporulating and non-sporulating growth, and more preferably, no sporulating or non-sporulating growth. Where the sheet material used to form the facing is a multilayer sheet material including layers other than a kraft paper sheet layer, a fungi growth-inhibiting agent or fungi growth-inhibiting agent and pesticide may be included in any one or more or all of the layers in the sheet material, especially the outermost layer, mixed throughout the layers, or applied topically. Where the sheet material includes one or more polymeric film layers in addition to the kraft paper sheet layer, a fungi growth-inhibiting agent or fungi growth-inhibiting agent and pesticide also may be included in any one or more of the polymeric film layers. Where the sheet material includes one or more mineral coating, polymeric coating, or ink coating layers, a fungi growth-inhibiting agent or fungi growth-inhibiting agent and pesticide also may be included in any one or more of the coating layers. Where the sheet material includes one or more nonwoven polymeric filament or fiber mat layers or nonwoven glass fiber mat layers, a fungi growth-inhibiting agent or fungi growth-inhibiting agent and pesticide also may be included in any one or more of the mat-layers. A fungi growth-inhibiting agent or fungi growth-inhibiting agent and pesticide can also be included in the bonding layer bonding the central field portion of the facing to the first major surface of the insulation layer.

Where a kraft paper sheet used in the sheet material of the subject invention contains the fungi growth-inhibiting agent, the fungi growth-inhibiting agent may be combined with the cellulose fibrous material of the kraft paper sheet, to become a substantive part of the cellulosic fibrous material, at different stages of an otherwise conventional kraft paper manufacturing process. For example, the fungi growth-inhibiting agent may be included in the fibrous slurry used to form the kraft paper sheet; or prior to drying the kraft paper sheet, a suspension or a solution containing the fungi growth-inhibiting agent may be sprayed onto one or both major surfaces of the kraft paper sheet while the kraft paper sheet is still wet or damp; or prior to drying the kraft paper sheet, a suspension or solution containing the fungi growth-inhibiting agent may be applied to both major surfaces of the kraft paper sheet while the kraft paper sheet is still wet or damp by passing the kraft paper sheet through a bath suspension or solution containing the fungi growth-inhibiting agent. While the application of a fungi growth-inhibiting agent to a kraft paper sheet used in the sheet material of the subject invention subsequent to the manufacture of the kraft paper sheet may not be as enduring as introducing the fungi growth-inhibiting agent into the kraft paper sheet during the manufacturing process as set forth above, after the kraft paper sheet is manufactured and dried, a coating containing the fungi growth-inhibiting agent may be applied to one or both of the major surfaces of the kraft paper sheet used in the sheet material of the subject invention by spraying a suspension or a solution containing the fungi growth-inhibiting agent onto one or both major surfaces of the kraft paper sheet or a suspension or solution containing the fungi growth-inhibiting agent may be applied to both major surfaces of the kraft paper sheet by passing the kraft paper sheet through a bath suspension or solution containing the fungi growth-inhibiting agent. Where a suspension or solution containing the fungi growth-inhibiting agent is sprayed onto a major surface of a kraft paper sheet of the subject invention, either during or subsequent to the manufacturing process, preferably, the entire surface of the major surface sprayed is covered or substantially covered with the suspension or solution. It should also be noted that the fungi growth-inhibiting agent used in the subject invention may comprise one fungi growth-inhibiting agent or a combination or blend of two or more fungi growth-inhibiting agents to provide a broader or more efficacious fungi growth resistance for the sheet materials of the subject invention.

An example of a fungi growth-inhibiting agent that may be used in the subject invention is a compounded additive sold by Ciba Specialty Chemicals under the trade designation Irgaguard F-3000 fungi growth resistance additive. It is believed that the inclusion of the Irgaguard F-3000 fungi growth resistance additive in amounts between 0.05% and 0.5% by weight of the materials in the polymeric film, polymeric coating, mineral coating, ink coating, and kraft or tissue paper layers of the first through the fifth sheet materials will effectively inhibit fungi growth in those layers. Examples of other antimicrobial, biocide fungi growth-inhibiting agents that may be used in the subject invention are silver zeolyte fungi growth inhibiting agents sold by Rohm & Haas Company under the trade designation KATHON fungi growth-inhibiting agent, by Angus Chemical Company under the trade designation AMICAL 48 fungi growth-inhibiting agent, and by Healthshield Technologies, LLC. under the trade designation HEALTHSHIELD fungi growth-inhibiting agent. Sodium pyrithione and zinc pyrithione, which are commonly available, may also be used as fungi growth-inhibiting agents in the subject invention; and where the sheet material includes an asphalt coating layer, zinc oxide in amounts between 3% and 20% by weight may be used as a filler in the asphalt to make the asphalt fungi growth resistant or to at least enhance the fungi-growth inhibiting characteristics of the asphalt.

An example of one type of pesticide that may be used in the subject invention is a termiticide that contains fipronil as the active ingredient. This termiticide is non-repellent to termites and lethal to termites through ingestion, contact and/or transferal. Aventis Environmental Science USA of Montvale, N.J. sells such a termiticide under the trade designation "TERMIDOR". Since the termites do not smell, see or feel this termiticide, the termites continue to pass freely through the treated area picking up the termiticide and carrying the termiticide back to the colony nest. In the colony nest, other termites that contact the contaminated termites through feeding or grooming or through cannibalizing the termites killed by the termiticide become carriers of the termiticide thereby spreading the termiticide throughout the colony and exterminating the termites.

Preferably, each faced insulation assembly of the subject invention has a flame spread and smoke developed rating equal to or less than 25/50 as measured by the ASTM E 84-01 tunnel test method, entitled "Standard Test Method for Surface Burning Characteristics of Building Materials", published July 2001, by ASTM International of West Conshohocken, Pa. Each sheet material of the subject invention and facing of the subject invention, as bonded to the insulation layer, passes the ASTM fungi test C 1338-00, entitled "Standard Test Method for Determining Fungi Resistance of Insulation Materials and Facings", published August 2000, by ASTM lnternational of West Conshohocken, Pa. Preferably, each sheet material of the subject invention and each facing of the subject invention, as bonded to the insulation layer, has a rating of 1 or less and, more preferably 0, as rated by the ASTM fungi test G 21-96 (Reapproved 2002), entitled "Standard Practice for determining Resistance of Synthetic Polymeric Materials to Fungi", published September 1996 by ASTM International of West Conshohocken, Pa. Preferably, each kraft paper sheet of the subject invention is fungus resistant as tested by ASTM test designation D2020-92 (Reapproved 1999), entitled "Standard Test Methods for Mildew (Fungus) Resistance of Paper and Paperboard", published August 1992.

For certain applications, it is preferable to have the sheet material of the subject invention and the field portion of the facing formed from the sheet material of the subject invention, as bonded to the major surface of the insulation layer (e.g. major surface 26 of the insulation layer 24), exhibit a water vapor permeance rating no greater than 1 and, more preferably, approximately 1 grain/ft$^2$/hour/inch Hg (no greater than 1 perm and more preferably, approximately 1 perm) to provide a vapor retarder or barrier for the faced fibrous insulation blanket, e.g. a faced resilient fiberglass insulation blanket. For other applications, it is preferable to have the sheet material of the subject invention "water vapor breathable" and the field portion of the facing formed from the sheet material of the subject invention, as bonded to the major surface of the insulation layer (e.g. major surface 26 of insulation layer 24) water vapor breathable, i.e.—exhibit a water vapor permeance rating of more than 1 grain/ft$^2$/hour/inch Hg (more than 1 perm); preferably, exhibit a water vapor permeance rating of about 3 or more grain/ft$^2$/hour/inch Hg (about 3 or more perms) and, more preferably, exhibit a water vapor permeance rating of about 5 or more grain/ft$^2$/hour/inch Hg (about 5 or more perms) to provide a porous facing for the faced insulation assembly that permits the passage of water vapor through the faced surface of the faced insulation assembly of the subject invention. For sheet materials that normally have a water vapor permeance rating equal to or less than one perm, the sheet material forming the central field portion of the facing (field portion 32 in the facing 22) can be selectively modified (e.g. perforated) to increase the water vapor permeance rating to a desired level. If the sheet materials are perforated, the perforations may be either microscopic-perforations or macroscopic-perforations with the number and the size of the perforations per unit area of the central field portion of the facing being selected to achieve the desired water vapor permeance rating for the facing. In addition, the bonding layer bonding the central field portion of the modified facing to the first major surface of the insulation layer can be applied so that the facing as applied to the insulation layer provides the faced insulation assembly with the desired water vapor permeance rating. For example, the bonding layer applied to the central field portion of the modified facing could be formed as: a particulate layer, a fiberized layer, a series of spaced apart longitudinally extending strips of selected width(s) and spacing(s), a series of spaced apart transversely extending strips of selected width(s) and spacing(s), a uniform or random pattern of dots of selected size(s) and spacing(s), a continuous coating or film layer of a selected uniform thickness or selected varying thicknesses, or some combination of the above, to achieve with the water vapor permeance rating of the central field portion of the facing a selected water vapor permeance rating for the central field portion of the facing as applied to the first major surface of the insulation layer.

As discussed above, various bonding agents may be used as the bonding layer to bond the sheet material forming the central field portion of the facings of the subject invention to the major surface of the insulation layer, such as but not limited to asphalt and amorphous polypropylene, and these bonding agents may be applied by different methods. For example, as the faced insulation assembly is being manufactured, the bonding layer could be applied to the inner major surface of the facing immediately prior to applying the facing to the insulation layer by: printing the bonding layer on the inner major surface of the facing, applying the bonding layer to the inner major surface of the facing as a particulate or fiberized a hot melt spray or water based spray, or by applying a water based or other bonding layer to the inner major surface of the facing by roll coating. Alternatively, the bonding layer, e.g. a heat activated, bonding layer, can be preapplied to the inner major surface of the facing when the facing is manufactured and rolled into long rolls and the bonding layer can be activated when the rolls of facing are unwound and adhered to the major surface of the insulation layer.

FIGS. 9 to 22 show additional embodiments of the faced insulation assembly of the subject invention. The elements of the faced insulation assemblies of FIGS. 9 to 22 that correspond to those of FIGS. 1 to 3 will have corresponding reference numerals in the hundreds with the same last two digits as the reference numerals used for those elements in FIGS. 1 to 3. Unless otherwise stated the elements of FIGS. 9 to 22 identified with reference numerals having the same last two digits as the reference numerals referring to those elements in FIGS. 1 to 3 are and function the same as those of FIGS. 1-3.

FIG. 9 shows a partial cross section of a faced insulation assembly 120 of the subject invention with a facing sheet 122 that is bonded by a bonding layer 136 to an insulation layer 124 and has Z-folded tabs 158 (only one of which is shown) and FIG. 10 shows a partial cross section of a faced insulation assembly 220 with of the subject invention with a facing sheet 222 that is bonded by a bonding layer 236 to an insulation layer 224 and has C-folded tabs 260 (only one of which is shown) that can be unfolded and extended beyond the lateral surface of the insulation layer 124 or 224 for attachment to and/or to overlay framing members. The Z-folded tabs 158 and C-folded tabs 260 are substituted for the tabs 34, are typically between about 0.25 and about 1.5 inches in width, and typically can be extended beyond the lateral surfaces of the insulation layers 124 and 224 between about 0.25 and about 1.5 inches. Like the central field portion 32 and lateral tabs 34 of facing 22, the central field portion 132 and lateral tabs 158 of facing 122 and the central field portion 232 the lateral tabs 260 of the facing 222 are made from the same piece of sheet material.

FIGS. 11 and 12 show partial cross sections of additional embodiments 320 and 420 of the faced insulation assembly of the subject invention. In the facings 322 and 422 of the embodiments 320 and 420 are bonded by bonding layers 336 and 436 to insulation layers 324 and 424, lateral tabs 364 and 466 are substituted for the lateral tabs 34 of facing 22. The tabs 364 and 466 are made of materials that differ from the material used to form the central field portions 332 and 432 of the facings 322 and 422; are bonded by adhesive layers 368 and 470, by ultra sonic welding or by other bonding means to the upper surface of lateral edge portions of the central field portion 332 and 432 of the facings 322 and 422;

and are typically between about 0.25 and about 1.5 inches in width. The tab 364 of the faced insulation assembly 320 is like the tab 34 of the faced insulation assembly 20. The tab 466 of the faced insulation assembly 420 of FIG. 12 is a Z-folded tab. The tabs 364 and 466 can be unfolded and extended beyond the lateral surfaces of the insulation layers 324 and 424 (typically extended between 0.25 and 1.5 inches beyond the lateral surfaces of the insulation layers) for attachment to or to overlay framing members.

FIG. 13 shows an embodiment 520 of the faced insulation assembly of the subject invention wherein both the facing 522 and the insulation layer 524 are longitudinally separable to form faced insulation sections 572 having lesser widths than the faced insulation assembly 520. The facing 522 is bonded to the insulation layer 524 by the bonding layer 536. The insulation layer 524 has one or more longitudinally extending series of cuts and separable connectors, schematically represented by lines 574, which enable the insulation layer 524 to be pulled apart or separated by hand into the insulation sections 572 of lesser widths than the insulation layer 524. For each such series of cuts and separable connectors 574 in the insulation layer 524, the field portion 532 of the sheet forming the facing 522 has a line of weakness 576 therein that is longitudinally aligned with the series of cuts and separable connectors so that the facing can also be separated or pulled apart by hand at each series of cuts and separable connectors. The line of weakness 576 may be formed as a perforated line, as an etched score line that reduces the thickness of the sheet material along the line, or the line may be otherwise weakened to facilitate the separation of the facing sheet by hand along the line 576. Other than the one or more series of cuts and separable connectors 574 in the insulation layer 524 and the one or more lines of weakness 576 in the facing 522, the faced insulation assembly 520 of FIG. 13 is the same as the faced insulation assembly 20.

FIGS. 14 and 15 show an embodiment 620 of the faced insulation assembly of the subject invention wherein both the facing 622 and the insulation layer 624 are longitudinally separable to form faced insulation sections 678 having lesser widths than the faced insulation assembly 624. The facing 622 is bonded to the insulation layer 624 by the bonding layer 636. The insulation layer 624 has one or more longitudinally extending series of cuts and separable connectors, schematically represented by lines 680, which enable the insulation layer 624 to be pulled apart or separated by hand into the insulation sections 678 of lesser widths than the insulation layer 624. For each such series of cuts and separable connectors 680 in the insulation layer 624, the field portion 632 of the sheet forming the facing 622 has a fold 682 therein that is longitudinally aligned with the series of cuts and separable connectors. A separable pressure sensitive or other separable bonding adhesive 684 separably bonds the two segments of each fold 682 to each other and, typically, the fold line 686 joining the segments of each fold 682 will be perforated, scored, or otherwise weakened to permit the fold to be pulled apart or separated by hand at the fold line 686 to form tab segments. Preferably, each segment of each fold 682 is between about 0.25 and about 1.5 inches in width. Other than the one or more series of cuts and separable connectors 680 in the insulation layer 624 and the one or more folds 682 in the facing 622 with weakened fold lines 686, the faced insulation assembly 620 of FIGS. 14 and 15 is the same as the faced insulation assembly 20.

FIGS. 16, 17 and 18 show a faced insulation assembly 720 of the subject invention that is faced with a facing 722 of the subject invention without preformed tabs. The faced insulation assembly 720 of FIGS. 16, 17 and 18 includes the facing 722 and an insulation layer 724. Preferably, the insulation layer 724 is made of a resilient insulation material, such as but not limited to a fiberglass insulation, that can be compressed in the direction of its width, e.g. laterally compressed an inch or more, and, after the compressive forces are released, will recover or substantially recover to its initial width. The insulation layer 724 has first and second major surfaces 726 and 728, which are defined by the length and width of the insulation layer, and a thickness. The facing 722 of the faced insulation assembly 720 is formed by a sheet material that has a central field portion 732, that is substantially coextensive with the first major surface of the insulation layer 724, but has no preformed tabs. The central field portion 732 of the facing 722 has a first outer major surface and a second inner major surface. The central field portion 732 of the facing 722 overlays and is bonded, typically by a bonding layer 736 on the inner major surface of central field portion 732 of the facing, to the major surface 726 of the insulation layer 724. As best shown in FIG. 17, in a preferred form of this embodiment, the bonding layer 736 bonding the central field portion 732 of the facing to the first major surface 726 of the insulation layer 724 does not extend to the lateral edges of either the insulation layer 724 or the facing 722 so that the lateral edge portions 788 of the facing 722 (e.g. portions about 0.25 to about 1.5 inches in width) are not directly bonded to the major surface 726 of the insulation layer. When the insulation layer 724 is compressed laterally to fit between a pair of framing members that are spaced apart a distance less than the width of the faced insulation assembly 720, this structure facilitates the separation of the lateral edge portions 788 of the facing 722 from the insulation layer 724 so that the lateral edge portions 788 of the facing 722 can extend beyond the lateral surfaces of the laterally compressed insulation layer 724 (e.g. between 0.25 and 1.5 inches) to form lateral tabs. However, as shown in FIG. 18, the bonding layer 736 bonding the central field portion 732 of the facing 722 to the first major surface 726 of the insulation layer 724 may extend to the lateral edges of the insulation layer 724 and the facing 722 so that the bond between the lateral edge, portions 788 of the facing 722 and the major surface 726 of the insulation layer must be broken before the lateral edge portions 788 of the facing 722 can be separated from the major surface 726 of the insulation layer 724 and extended beyond the insulation layer to form the lateral tabs. With the embodiment of FIG. 18, if the installer does not desire to form lateral tabs on the facing 722 that extend laterally beyond the insulation layer when the insulation layer is compressed laterally, the installer can leave the lateral edge portions 788 of the facing 722 bonded to the lateral edge portions of the major surface 726 of the insulation layer.

FIGS. 19, 20 and 21 show an embodiment 820 of the faced insulation assembly of the subject invention wherein both the facing 822 and the insulation layer 824 are longitudinally separable to form faced insulation sections 890 having lesser widths than the faced insulation assembly 820. Like the faced insulation assembly 720 of FIGS. 16, 17 and 18, the facing of faced insulation assembly 820 does not have preformed tabs and the insulation layer 824 is preferably made of a resilient insulation material, such as but not limited to a fiberglass insulation, that can be compressed in the direction of its width, e.g. laterally compressed an inch or more, and, after the compressive forces are released, will recover or substantially recover to its initial width. The insulation layer 824 has one or more longitudinally extending series of cuts and separable connectors, schematically represented by lines 892, which enable the insulation layer 824 to be pulled apart or separated by hand into the insulation sections 890 of lesser widths than the insulation layer 824. For each such series of cuts and separable connectors 892 in the insulation layer 824, the field portion 832 of the sheet forming the facing 822 has a line of weakness 894 therein that is longitudinally aligned with the series of cuts and separable connectors and can be pulled apart or separated by hand. The line of weakness 894 may be formed as a perforated line, as an etched score line that reduces the thickness of the sheet material along the line, or the line may be otherwise weakened to facilitate the separation of the facing sheet along the line 894.

Preferably, as shown in FIG. 19, the bonding layer 836 bonding the central field portion 832 of the facing sheet to the first major surface 826 of the insulation layer 824 does not extend to the lateral edges of either the insulation layer 824 or the facing 822 so that the lateral edge portions 896 of the facing sheet are not directly bonded to the major surface 826 of the insulation layer. Preferably, the bonding layer 836 will end from about 0.25 to about 1.5 inches from the lateral edges of the facing sheet 822 and the insulation layer 824 so that the width of the unbonded lateral edge portions 896 is between about 0.25 and about 1.5 inches. Preferably, as shown in FIGS. 19 and 20, the bonding layer bonding the central field portion 832 of the facing sheet to the first major surface 826 of the insulation layer 824 is also omitted from portions 898 of the facing located adjacent each series of cuts and separable connectors 892 in the insulation layer 824 so that the facing is not directly bonded to the insulation layer along each series of cuts and separable connectors 892. Preferably, the bonding layer 836 will be omitted for a spacing of about 0.25 to about 1.5 inches from each side of each series of cuts and separable connectors in the insulation layer 824 and the lines 894 of weakness in the facing sheet 822 so that the widths of the unbonded facing portions 898 are between about 0.25 and about 1.5 inches. The omission of bonding agent from adjacent the lateral edges of the faced insulation assembly 820 facilitates the separation of the lateral edge portions 896 of the facing sheet from the insulation layer 824 so that the lateral edge portions 896 of the facing 822 can be extended as tabs beyond the lateral surfaces of the laterally compressed insulation layer 824 or extended as tabs beyond the lateral surfaces of compressed insulation sections 890 that have been separated from the insulation layer 824. The omission of bonding agent from adjacent the cuts and separable connectors 892 facilitates the separation of the portions 898 of the facing sheet from the insulation layer 824 adjacent each series of cuts and separable connectors 892 so that the portions 898 of the facing sheet can be extended as tabs beyond the lateral surfaces of the laterally compressed insulation sections 890. However, the bonding layer 836 bonding the central field portion 832 of the facing to the first major surface 826 of the insulation layer 824 may extend to the lateral edges of the insulation layer 824 and the facing sheet (e.g. as shown in FIG. 18) so that the lateral edge portions 896 of the facing sheet must be separated from the major surface 826 of the insulation layer 824 to form the lateral tabs and, as shown in FIG. 21, the facing may be directly bonded to the major surface 826 of insulation layer 824 adjacent each series of cuts and separable connectors 892 so that the portions 898 of the facing sheet must be separated from the major surface 826 of the insulation layer 824 to form tabs.

When the insulation layer 824 of faced insulation assembly 820 is compressed in the direction of its width to fit between a pair of framing members that are spaced a distance less than the width of insulation layer 824, the lateral edge portions 896 of the facing sheet separate or can be separated from the major surface 826 of the insulation layer and extended as tabs beyond the lateral surfaces of the laterally compressed insulation layer 824 to provide a vapor retarding barrier between the facing and the framing members and/or for attachment to the framing members. When an insulation section 890 of faced insulation assembly 820 is compressed in the direction of its width to fit between a pair of framing members that are spaced a distance less than the width of insulation section 890, the portions of the facing sheet adjacent the lateral surfaces of the compressed insulation section 890 (portions 896 and/or 898) separate or can be separated from the major surface 826 of the insulation layer and extended as tabs beyond the lateral surfaces of the laterally compressed insulation section 890 to provide a vapor retarding barrier between the facing and the framing members and/or for attachment to the framing members. Where the central field portion 832 of the facing 822 is bonded to the major surface 826 of the insulation layer 824 across their entire widths, the installer may choose to leave the facing 822 bonded to the major surface of the insulation layer so that no lateral tabs are formed on the insulation layer or sections of the insulation layer when they are compressed laterally.

Figure 22:
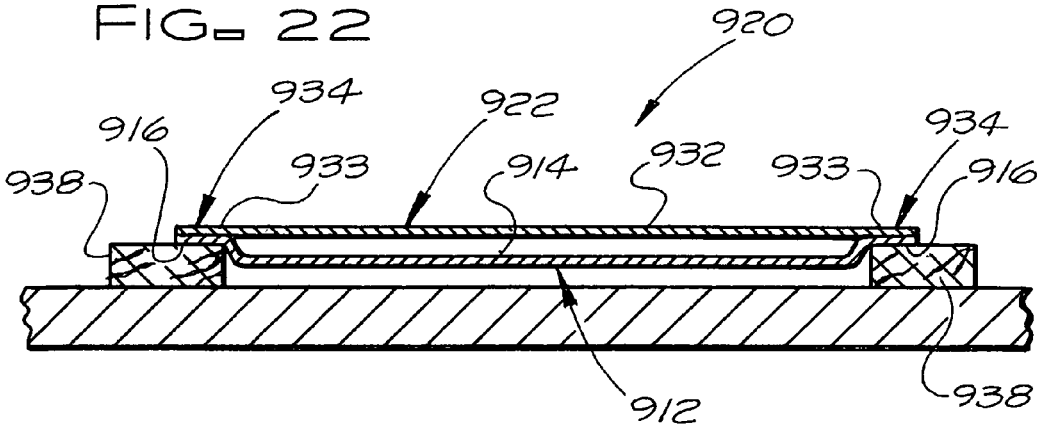
FIG. 22 is a schematic view of a reflective insulation made with the fungi growth resistant kraft paper facings of the subject invention.

FIG. 22 shows an embodiment 920 of the faced insulation assembly of the subject invention. The faced insulation assembly 920 may include a facing 922 made of a fungi growth resistant kraft sheet or kraft sheet material, such as any of the first through the fifth sheet materials described above in this specification, and a reflective sheet 912 that radiates heat, e.g. a foil sheet material, a metallized film, or other metallized sheet material. The faced insulation assembly 920 may include a kraft-reflective layer or kraft-reflective layer-kraft facing 922 made of a fungi-growth resistant kraft sheet or kraft sheet material, such as any of the first through the fifth sheet materials described above in this specification, laminated to a reflective sheet material that radiates heat, e.g. a foil sheet material, a metallized film, or other metallized sheet material and a reflective sheet 912 that radiates heat, e.g. a foil sheet material, a metallized film, or other metallized sheet material. The faced insulation assembly 920 may include a kraft-reflective layer or kraft-reflective layer-kraft facing 922 made of a fungi resistant kraft sheet or kraft sheet material, such as any of the first through the fifth sheet materials described above in this specification, laminated to a reflective sheet material that radiates heat, e.g. a foil sheet material, a metallized film, or other metallized sheet material and a kraft-reflective layer or kraft-reflective layer-kraft reflective sheet 912 made of a fungi resistant kraft sheet or kraft sheet material, such as any of the first through the fifth sheet materials described above in this specification, laminated to a reflective sheet material that radiates heat, e.g. a foil sheet material, a metallized film, or other metallized sheet material. Preferably, the faced insulation assembly 920 includes a kraft-foil facing 922 with one of first through the fifth sheet materials described above in this specification laminated to a foil sheet material and a kraft-foil reflective sheet 912 with one of first through the fifth sheet materials described above in this specification laminated to a foil sheet material. Preferably, the foil sheet material of the kraft-foil facing 922 opposes the kraft-foil reflective sheet 912. However, either the kraft sheet material or the foil sheet material of the kraft-foil reflective sheet 912 may oppose the facing 922.

The facing 922 of the faced insulation assembly 920 is formed of a sheet material that has a central field portion 932 extending between a pair of lateral edge portions 933 that are typically between 0.25 and 1.5 inches in width. For certain applications, it is preferable to have the field portion of the facing 922 "water vapor breathable", i.e. exhibit a water vapor permeance rating of more than 1 grain/ft$^2$/hour/inch Hg (more than 1 perm); preferably, exhibit a water vapor permeance rating of about 3 or more grain/ft$^2$/hour/inch Hg (about 3 or more perms) and, more preferably, exhibit a water vapor permeance rating of about 5 or more grain/ft$^2$/hour/inch Hg (about 5 or more perms) to provide a facing for the faced insulation assembly 920 that permits the passage of water vapor through the faced surface of the faced insulation assembly of the subject invention. The central field portion of the facing 922 may be perforated to provide the necessary porosity to obtain the desired water vapor permeance rating for the faced insulation assembly 920.

The reflective sheet 912 has a central field portion 914 extending between a pair of lateral edge portions 916 that are typically between 0.25 and 1.5 inches in width. The central field portion 932 of the facing 922 and the central field portion 914 of the reflective sheet 912 are spaced from each other (e.g. spaced from each other 0.25 and 0.50 inches) to form an insulating air space between the central field portion 932 of the facing 922 and the central field portion 914 of the reflective sheet 912. In addition, there may be a spacer or spacers (e.g. paperboard spacers not shown) between the central field portion 932 of the facing 920 and the central field portion 914 of the reflective sheet 912 to assure that a spacing is maintained between the central field portion of the facing and the central field portion of the reflective sheet. The lateral edge portions 933 of the facing 922 and the lateral edge portions 916 of the reflective sheet layer 912 are bonded together to form the lateral tabs 934 of the faced insulation assembly 920 that extend laterally beyond the insulating portion of the faced insulation assembly, e.g. to overlap framing members (e.g. furring strips 938 or other framing members) forming a cavity being insulated by the faced insulation assembly and/or for attachment to framing members forming a cavity being insulated by the faced insulation assembly.

The faced insulation assembly 920 is typically about 15 to 16 or 23 to 24 inches in width for application to cavities defined by framing members located on 16 inch or 24 inch centers and is typically cut to the length of a cavity, e.g. to a length of about eight feet, from a longer length of the faced insulation assembly. The faced insulation assembly 920 is typically packaged, stored, shipped, and handled prior to application in roll form with the facing 922 and the reflective sheet 912 of the faced insulation assembly collapsed together. When installed in a cavity, the faced insulation assembly 920 is cut to a desired length and the tabs 934 of the assembly are pulled laterally to expand the faced insulation assembly and separate the facing 922 and the reflective sheet 912 from each other to create an air space between the facing and the reflective sheet that is typically between 0.25 and 0.50 inches in width.

Figure 23:
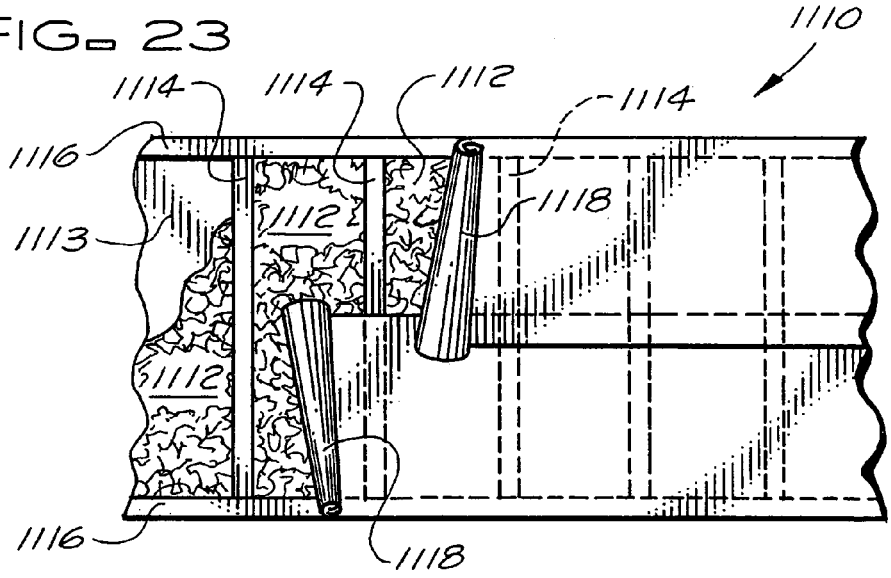
FIGS. 23 and 24 are partial elevations of walls insulated with unfaced insulation batts that are overlaid by any of the first through the fifth sheet materials of the subject invention.
Figure 24:
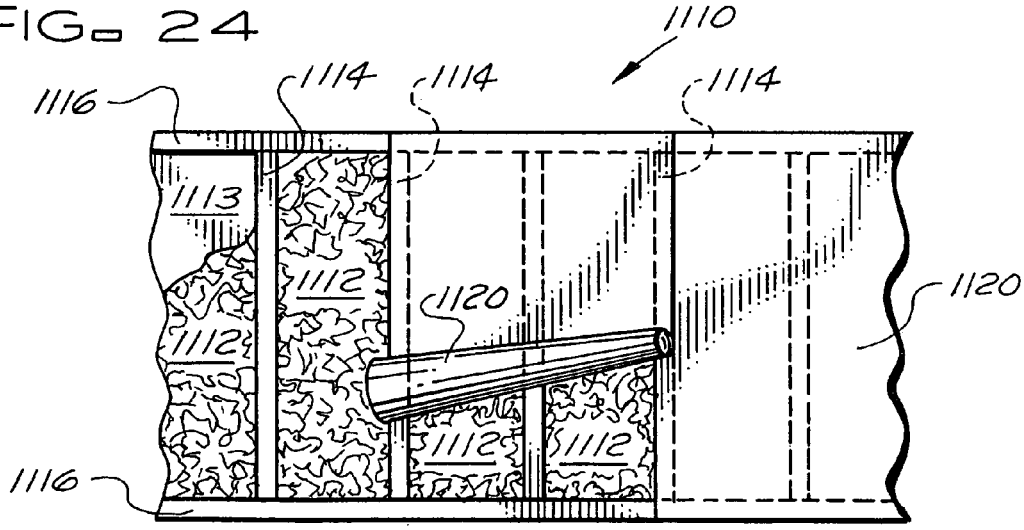

FIGS. 23 and 24 show hollow building walls 1110 with cavities that are insulated with unfaced insulation batts 1112, e.g. unfaced fiberglass insulation batts. The wall cavities are each defined by: a wall covering 1113 (such as but not limited to sheathing or gypsum board that is shown where the insulation balts 1112 are broken away); spaced-apart vertically extending framing members 1114 (e.g. studs); and horizontally extending framing members 1116 (e.g. wall plates).

In FIG. 23, upper and lower sheets 1118, which are partially peeled back to show the insulation balts and framing structure of the wall 1110, overlay the unfaced insulation batts 1112. The sheets 1118 may be made of any of the first through the fifth sheet materials described above in this specification. As applied to the framing members 1114 and 1116, the longitudinal centerlines of the sheets 1118 extend horizontally with the lower lateral edge portion of the upper sheet and upper lateral edge portion of the lower sheet overlapping each other so that the sheets 1118 form a vapor retarding layer of the wall. The sheets 1118 may be unrolled from rolls of the sheet material, cut to desired lengths, and secured to the framing members 1114 and 1116 by staples, beads of adhesive preapplied to the framing members, or by other securing means. Preferably, the sheets 1118 have thicknesses between 2 and 6 mils and have widths that enable the sheets to be overlapped by several inches and, together, extend for the entire height of the wall, e.g. for a eight foot high wall the sheets 1118 may each be about fifty inches in width and about twenty to about one hundred feet long. It is also contemplated that one sheet could be used rather than the two sheets 1118 and that such a sheet would be about eight feet in width for an eight-foot high wall.

In FIG. 24, side-by-side sheets 1120, which are partially peeled back to show the insulation batts and framing structure of the wall 1110, overlay the unfaced insulation batts 1112. The sheets 1120 may be made of any of the first through the fifth sheet materials described above in this specification. As applied to the framing members 1114 and 1116, the longitudinal centerlines of the sheets 1120 extend vertically with the lateral edge portions of adjacent sheets 1120 being secured to the same vertical frame member 1114 or overlapping each other so that the sheets 1120 form a vapor retarding layer of the wall. The sheets 1120 may be unrolled from rolls of the sheet material, cut to desired lengths, and secured to the framing members 1114 and 1116 by staples, beads of adhesive preapplied to the framing members, or by other securing means. The sheets 1120 may have widths equal to the standard center to center spacing of the vertical frame members 1114 in a wall, e.g. 16 or 24 inch widths, so that the sheets each can overlie a single wall cavity and be secured to the vertical frame members defining the cavity. However, preferably, the sheets 1120 have thicknesses between 2 and 6 mils and have widths that are multiples of the standard cavity widths for a wall e.g. 32, 48, 64, 72, 84, or 96 inch widths that enable the sheets to overlie a plurality of wall cavities and be secured to vertical frame members 1114 of the wall.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A faced building insulation assembly for insulating a wall, ceiling, floor, or roof cavity, comprising:

an insulation layer formed by a fibrous insulation blanket; the insulation layer having a length, a width and a thickness; the insulation layer having first and second major surfaces defined by the length and width of the insulation layer;

a facing overlaying the first major surface of the insulation layer; the facing having a first outer major surface and a second inner major surface; the facing comprising a kraft paper sheet containing a fungi growth inhibiting agent introduced into the kraft paper sheet as the kraft paper sheet is being produced by being included in a fibrous slurry used to form the kraft paper sheet; the fungi growth-inhibiting agent contained in the kraft paper sheet being 2-(4-Thiazolyl) Benzimidazole; and a heat activated asphalt bonding layer containing a fungi growth inhibiting agent, on the second inner major surface of the sheet material that bonds the facing to the insulation layer whereby the facing, as bonded to the insulation layer, is fungi growth resistant; the fungi growth-inhibiting agent contained in the asphalt bonding layer being zinc pyrithione.

2. A faced building insulation assembly, comprising:

an insulation layer formed by a fibrous insulation blanket the insulation layer having a length, a width and a thickness; the insulation layer having first and second major surfaces defined by the length and width of the insulation layer;

a facing overlaying the first major surface of the insulation layer; the facing having a first outer major surface and a second inner major surface; the facing consisting essentially of a kraft paper sheet containing a blend fungi growth inhibiting agents introduced into the kraft paper sheet as the kraft paper sheet is being produced by being included in a fibrous slurry used to form the kraft paper sheet; the blend of fungi growth-inhibiting agents contained in the kraft paper sheet including 2-(4-Thiazolyl) Benzimidazole; and a heat activated asphalt bonding layer containing a blend of fungi growth inhibiting agents, on the second inner major surface of the sheet material that bonds the facing to the insulation layer whereby the facing, as bonded to the insulation layer, is fungi growth resistant; the blend of fungi growth-inhibiting agents contained in the asphalt bonding layer including zinc pyrithione.

* * * * *